US010556239B2

(12) United States Patent
Giesemann et al.

(10) Patent No.: US 10,556,239 B2
(45) Date of Patent: Feb. 11, 2020

(54) METHOD FOR OPERATING AN INSTALLATION COMPRISING AT LEAST ONE ASSEMBLY WITH A ROTATING SURFACE

(71) Applicant: ThyssenKrupp Industrial Solutions AG, Essen (DE)

(72) Inventors: Reinhard Giesemann, Harsewinkel (DE); Richard Erpelding, Soest (DE); Uwe Bendig, Hamm (DE); Dirk Dilly, Dortmund (DE); Dirk Schefer, Ennigerloh (DE)

(73) Assignee: THYSSENKRUPP INDUSTRIAL SOLUTIONS AG, Essen (DE)

( * ) Notice: Subject to any disclaimer, the term of this patent is extended or adjusted under 35 U.S.C. 154(b) by 983 days.

(21) Appl. No.: 15/026,351

(22) PCT Filed: Sep. 29, 2014

(86) PCT No.: PCT/EP2014/002635
§ 371 (c)(1),
(2) Date: Mar. 31, 2016

(87) PCT Pub. No.: WO2015/049043
PCT Pub. Date: Apr. 9, 2015

(65) Prior Publication Data

US 2016/0243556 A1 Aug. 25, 2016

(30) Foreign Application Priority Data

Oct. 2, 2013 (DE) ..... 10 2013 110 981

(51) Int. Cl.
*B02C 25/00* (2006.01)
*B02C 4/28* (2006.01)
(Continued)

(52) U.S. Cl.
CPC ..... *B02C 25/00* (2013.01); *B02C 4/28* (2013.01); *B02C 4/32* (2013.01); *B02C 4/42* (2013.01);
(Continued)

(58) Field of Classification Search
CPC ..... B02C 4/02; B02C 4/28; B02C 4/30–32; B02C 4/42; B02C 25/00; B02C 23/08; B02C 23/18; B02C 2210/01; B30B 3/40
(Continued)

(56) References Cited

U.S. PATENT DOCUMENTS 1,980,882 A * 11/1934 See ..... B29B 7/68 241/231
4,905,910 A * 3/1990 Wuestner ..... B02C 4/42 241/101.2
(Continued)

FOREIGN PATENT DOCUMENTS

AU 2008207358 B 3/2009
CN 101596477 A 12/2009
(Continued)

OTHER PUBLICATIONS

International Search Report for PCT/EP2014/002635 dated Nov. 28, 2014 (dated Dec. 10, 2014).

*Primary Examiner* — Shelley M Self
*Assistant Examiner* — Smith Oberto Bapthelus
(74) *Attorney, Agent, or Firm* — thyssenkrupp North America, Inc.

(57) ABSTRACT

An example method for operating a plant, which has at least one assembly with a rotating surface that wears to an increasing extent during the operation of the plant, may involve evaluating a wear state of the rotating surface of the assembly. Based on the wear state of the rotating surface, a manner in which the plant is operated may be modified to
(Continued)

prolong the running time of the assembly until, for instance, a next-scheduled service or maintenance interval. The modified manner of operating the plant may be adapted to the wear state of the rotating surface. Several examples of such modifications include changing a quantity of water sprayed onto material to be comminuted, changing a quantity of grinding additive added to material to be comminuted, and/or changing a contact pressure of a grinding roll of the assembly.

15 Claims, 4 Drawing Sheets

(51) Int. Cl.
*B02C 4/32* (2006.01)
*B02C 4/42* (2006.01)
*B02C 23/08* (2006.01)
*B02C 23/18* (2006.01)
*B30B 3/04* (2006.01)

(52) U.S. Cl.
CPC ..... *B02C 23/08* (2013.01); *B02C 23/18* (2013.01); *B30B 3/04* (2013.01); *B02C 2210/01* (2013.01)

(58) Field of Classification Search
USPC ..... 241/37
See application file for complete search history.

(56) References Cited

U.S. PATENT DOCUMENTS 4,912,956 A * 4/1990 Matricon ..... B21B 29/00 72/11.7
4,943,347 A * 7/1990 Floden ..... D21D 1/30 162/61
4,973,001 A * 11/1990 Kastingschafer ..... B02C 4/32 100/170
5,271,570 A * 12/1993 Satake ..... B02C 9/04 241/42
5,351,894 A * 10/1994 Longhurst ..... B02C 4/02 241/21
5,522,557 A * 6/1996 Tiggesbaumker ..... B02C 4/32 241/227
5,722,605 A * 3/1998 Finken ..... B02C 4/32 241/231
6,199,778 B1 * 3/2001 Hanvey, Jr. ..... B02C 4/08 241/152.2
6,295,851 B1 * 10/2001 Sjostrom ..... B21B 37/58 72/10.1
6,695,911 B2 * 2/2004 Ramesohl ..... B02C 4/02 106/745
7,182,283 B1 * 2/2007 Santucci ..... B02C 15/06 241/101.3
7,226,006 B2 * 6/2007 Porter ..... A61L 11/00 209/11
7,451,945 B2 * 11/2008 Wollenhaupt ..... B02C 4/02 100/168
7,708,221 B2 * 5/2010 Engel ..... A01D 43/10 241/230
7,775,465 B2 * 8/2010 Burchardt ..... B02C 4/02 241/24.25
7,926,749 B2 * 4/2011 Santandrea ..... B02C 18/0084 241/24.11
8,292,207 B2 * 10/2012 Fard ..... B02C 4/02 241/222
8,297,183 B2 * 10/2012 Horster ..... B02C 4/02 100/168
8,544,774 B1 * 10/2013 Harbold ..... B02C 23/04 241/30
8,632,028 B2 * 1/2014 Euculano ..... B02C 4/32 241/231
8,662,431 B2 * 3/2014 Gronvall ..... B02C 4/32 241/101.3
8,695,907 B2 * 4/2014 Reznitchenko ..... B02C 4/02 241/226
8,703,883 B2 * 4/2014 McDaniel ..... C08F 210/14 241/24.1
8,708,265 B2 * 4/2014 Hendrix ..... B02C 4/32 241/230
8,764,523 B2 * 7/2014 Ludwig ..... B02C 25/00 452/142
8,967,507 B2 * 3/2015 Pusheck ..... B02C 4/08 241/32
9,004,385 B2 * 4/2015 Leshem ..... B02C 19/0093 241/100
9,016,605 B2 * 4/2015 Bourgeois ..... B02C 4/02 241/79
9,409,179 B2 * 8/2016 Ueda ..... B02C 4/02
9,498,779 B2 * 11/2016 Brendler ..... B30B 3/04
2004/0005369 A1 * 1/2004 Chuang ..... A61K 36/258 424/728
2005/0263630 A1 * 12/2005 Zhang ..... B02C 15/00 241/100
2010/0252667 A1 * 10/2010 Dilly ..... B02C 15/04 241/230
2012/0111982 A1 * 5/2012 Ruther ..... B02C 4/32 241/227
2012/0264865 A1 * 10/2012 Shaw ..... C01F 11/185 524/425
2013/0001333 A1 * 1/2013 Rass ..... A21D 2/266 241/2
2014/0183289 A1 * 7/2014 Scales ..... B30B 9/20 241/3
2015/0253131 A1 * 9/2015 Webster ..... G01B 11/25 241/101.3
2015/0258576 A1 * 9/2015 Hagemeier ..... B07B 4/02 241/61
2016/0101424 A1 * 4/2016 Frerich ..... B02C 4/02 241/230
2016/0243556 A1 * 8/2016 Giesemann ..... B02C 4/28

FOREIGN PATENT DOCUMENTS

DE 4443210 A1 6/1996
DE 102007004004 A1 7/2008
DE 102007038956 A 2/2009
EP 0538771 A1 4/1993
EP 0578152 A1 1/1994

* cited by examiner

METHOD FOR OPERATING AN INSTALLATION COMPRISING AT LEAST ONE ASSEMBLY WITH A ROTATING SURFACE

CROSS REFERENCE TO RELATED APPLICATIONS

This application is a U.S. National Stage Entry of International Patent Application Serial Number PCT/EP2014/002635, filed Sep. 29, 2014, which claims priority to German Patent Application No. DE 102013110981.0 filed Oct. 2, 2013, the entire contents of both of which are incorporated herein by reference.

FIELD

The present disclosure relates to methods for operating plants and, more particularly, to methods for operating plants in ways that extend the service life of surfaces that wear during operation of such plants.

BACKGROUND

In roll mills, the roll surfaces, in particular in the case of roll presses, are frequently protected by profile bodies. To this end, cylindrical hard metal pins are very frequently used in practice which are introduced into a soft basic matrix and form an autogenous wear protection layer with the material to be ground. Roll mills of this type are used for grinding limestone, dolomite or other brittle materials, such as during the processing of ore.

Roll mills of this type are usually reconditioned at regular intervals of, for example, 12 months. Down times in the case of the mills which are as a rule very large have to be kept as low as possible for reasons of economy. As a result of locally increased wear or as a result of the loss of individual hard metal pins, however, pronounced erosion can occur at said locations, with the result that the basic material of the roll main body is damaged irreparably and renewed reconditioning is no longer possible and the complete roll has to be conditioned or even replaced. In practice, regular visual checks are therefore carried out.

DE 10 2007 004 004 A1 has disclosed a roll mill having two grinding rolls which are driven in opposite directions, each grinding roll having a roll main body which is fitted with a multiplicity of profile bodies. Furthermore, a monitoring apparatus is provided which checks the wear state of the multiplicity of profile bodies and detects any wear at an early stage. A wear prognosis of the roll surface is derived herefrom, in order for it to be possible to plan the next reconditioning in good time, with the result that unnecessary down times are avoided.

Since the reconditioning of a grinding roll is made possible only with relatively great outlay which often also requires transport to central conditioning stations, the usual reconditioning intervals are already set with a relatively long lead time, with the result that unplanned conditioning often cannot be carried out promptly. Secondly, premature reconditioning of the grinding roll is also to be avoided as far as possible from an economical aspect. One therefore often makes do with the improvement of individual locations which can be carried out on site.

DETAILED DESCRIPTION

Figure 1:
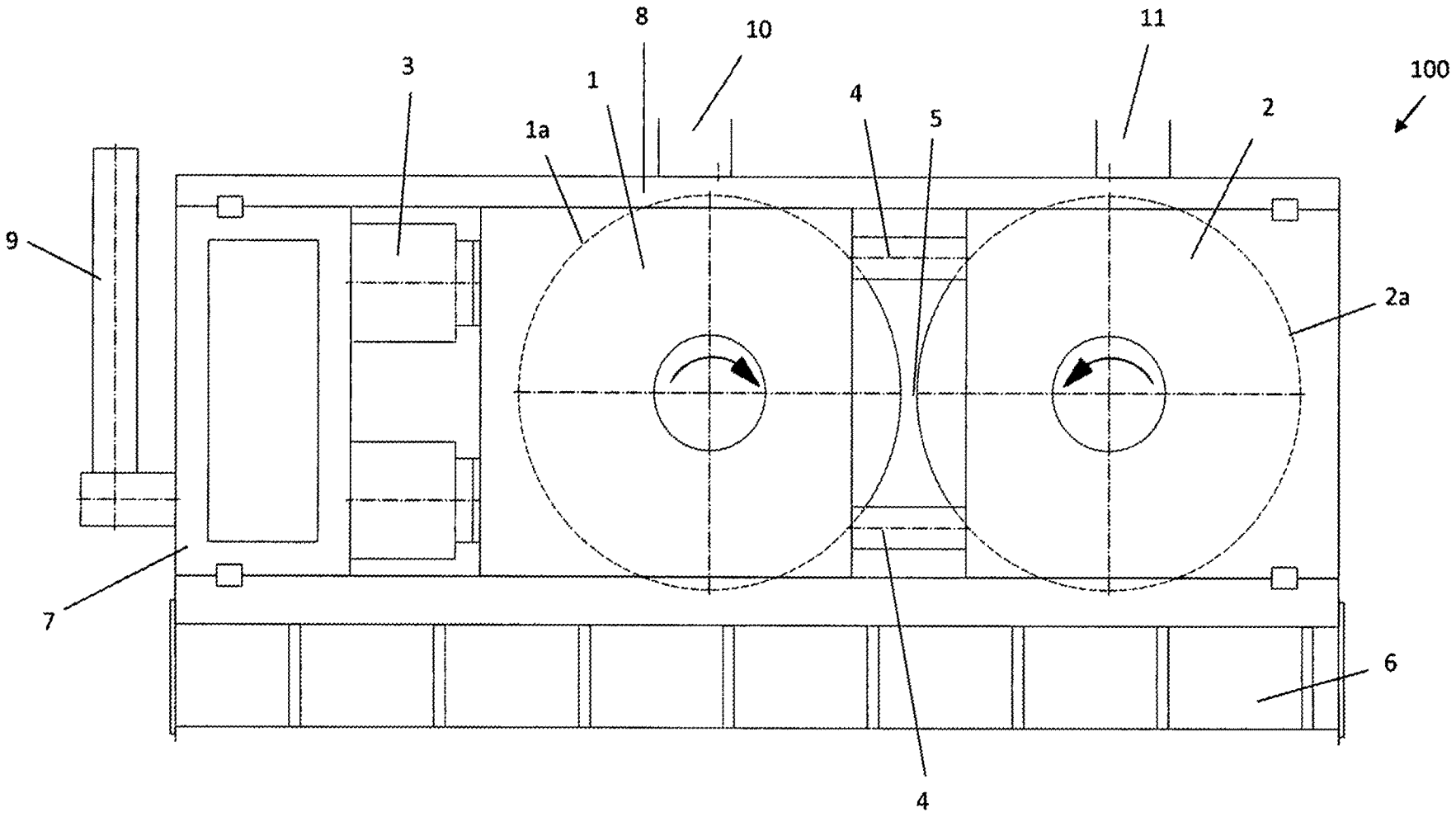
FIG. 1 is a side view of an example roll press with an example monitoring apparatus.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

The present disclosure generally concerns example methods for operating a plant having at least one assembly that has a rotating surface that wears to an increasing extent during the operation of the plant, where the wear state of the rotating surface is determined and evaluated. The assembly may be, for example, a grinding roll, as is used, for instance, in a roll press. However, the assembly may also be, for example, running rings here of circumferentially mounted cylinders, such as roller mills or rotary kilns.

One object of the present disclosure is to specify methods for operating a plant having at least one assembly that has a rotating surface that wears to an increasing extent during the operation of the plant, which method makes a more economical method of operation of the plant possible.

One example way to achieve this object is by virtue of the fact that the wear state of the rotating surface is determined and evaluated, wherein an instruction for a modified further method of operation of the plant that is adapted to the determined wear state of the rotating surface is given in a manner that is dependent on the wear state of the rotating surface.

Whereas merely a wear prognosis has been specified up to now or the assembly has possibly been prematurely repaired or conditioned, the present invention proposes a different path, by adapting the further method of operation of the assembly to the wear state. Although the assembly can possibly no longer be operated with the original performance in this way, it will nevertheless be more economical in many cases to operate the assembly with reduced performance than to permit further excessively rapid wear as an alternative which then leads to a premature down time of the plant.

Furthermore, the present invention makes a continuous overall optimization of the comminution system possible, by the wear progress continuously being incorporated as a parameter into the optimization of the overall process.

According to one preferred refinement of the invention, the wear state is determined during running operation of the plant. If the assembly is serviced or repaired at predefined intervals, it is provided according to a further refinement of the invention that the further method of operation of the plant which is adapted to the determined wear state of the rotating surface is set in such a way that the remaining running time of the assembly is adapted to the remaining time period until the provided service or repair. This is particularly expedient, above all, when a premature repair or service is not possible and premature wear of the surface would lead to an extended down time of the assembly. Here, the present invention takes the finding into consideration that the speed, at which the rotating surface wears, is dependent on the method of operation of the plant.

According to one preferred refinement of the invention, the plant serves to comminute bulky material, it being possible for the at least one assembly to be, in particular, a grinding roll. Here, the system can be operated as a roll press with two assemblies which are configured as grinding rolls.

The further method of operation of the plant which is adapted to the determined wear state of the rotating surface can consist, in particular, of a change in the rotational speed of the rotating surface.

If the plant consists of at least one grinding roll and has optionally an upstream screening stage and/or crushing stage for pre-treating the material to be comminuted and possibly an upstream bunker for the intermediate storage of the material to be comminuted and possibly a pressing device, the adapted further method of operation of the plant can take place by way of one or more of the method steps which are indicated in the following:

- changing the setting of the screening stage and/or crushing stage, influencing the material flow from the pre-bunker by way of changing the position of a slide,
- changing the water quantity to be sprayed into the bulky material to be comminuted,
- changing a grinding additive quantity to be added to the bulky material to be comminuted,
- changing the contact pressure of at least one grinding roll,
- changing the ratio of gas pressure to oil pressure of a hydro-pneumatic adjusting element of a pressing device, which adjusting element is operated using gas and oil, and
- changing the feed quantity of the bulky material to be comminuted.

Figure 2:
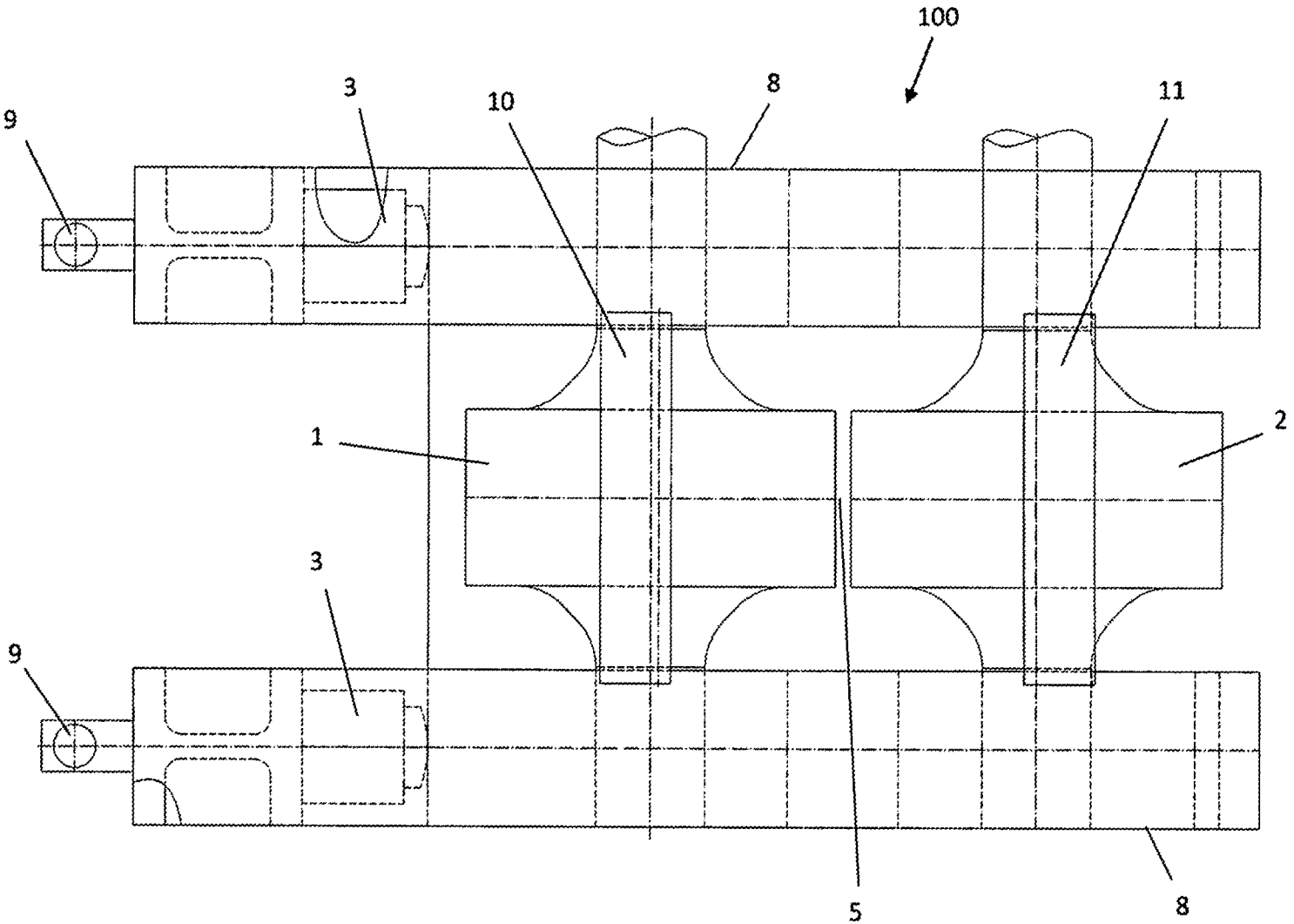
FIG. 2 is a plan view of the example roll press of FIG. 1.

The plant shown in FIGS. 1 and 2 for comminuting bulky material, such as for example limestone or one material, is a roll press having two assemblies 1 and 2 which are configured as grinding rolls and are pressed against one another in a manner known per se by way of a pressing device 3. A predefined grinding gap 5 is maintained by spacer elements 4. To this end, the two assemblies 1, 2 and the pressing device 3 are arranged in a machine frame which comprises a main frame 6, pressure beams 7 and top flanges 8. The pressing device 3 has a hydro-pneumatic adjusting element 9 which is operated using gas and oil and is correspondingly loaded in order to generate the grinding pressure.

The two assemblies 1, 2 which are configured as grinding rolls are driven in opposite directions via drives which are not shown in greater detail, the bulky material to be comminuted being fed to the grinding gap 5. The assemblies 1, 2 have rotating surfaces (circumferential surfaces 1*a*, 2*a*) which are usually provided with a suitable wear protective layer. Said wear protective layer can be assembled, for example, from wear protective segments which are applied over the full surface area. Furthermore, it is also known to form the wear protective layer by way of a multiplicity of pin-shaped profile bodies which are arranged at a spacing from one another and between which an autogenous wear protection layer is formed from material to be comminuted. However the rotating surface is configured, wear occurs during grinding operation, which wear is detected and evaluated for each assembly 1, 2 via at least one associated monitoring device 10 and 11, respectively.

Figure 3D:
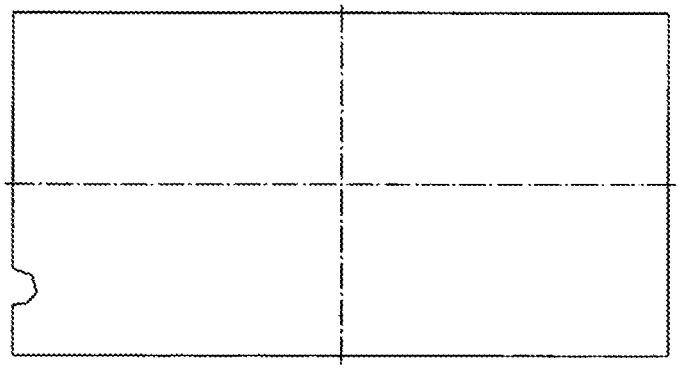
FIG. 3*d* is a fourth example wear profile of an example grinding roll.
Figure 3C:
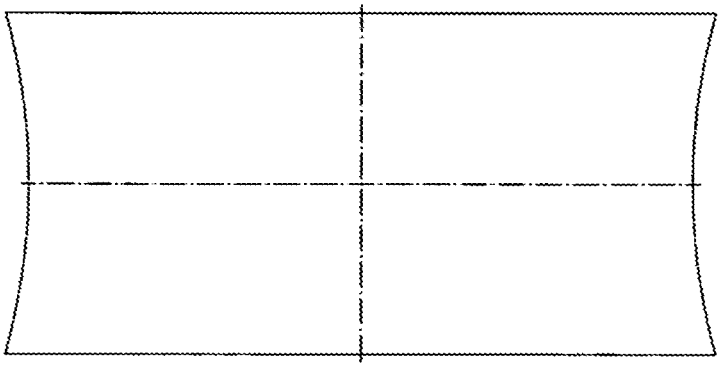
FIG. 3*c* is a third example wear profile of an example grinding roll.
Figure 3B:
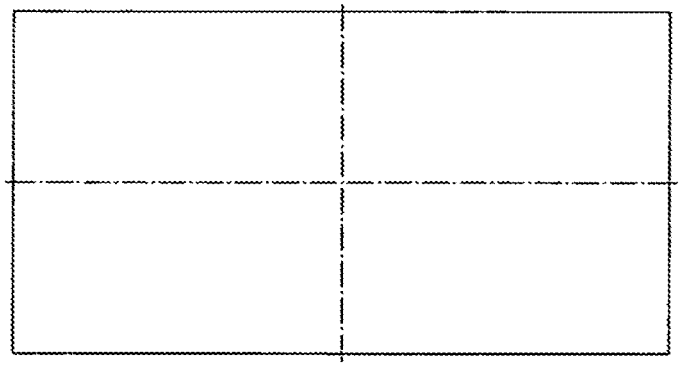
FIG. 3*b* is a second example wear profile of an example grinding roll.
Figure 3A:
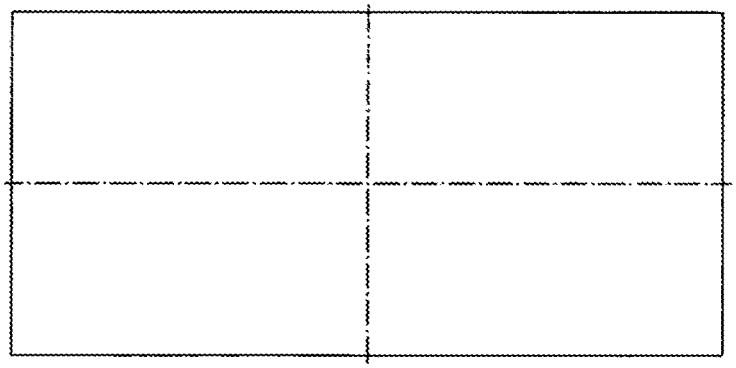
FIG. 3*a* is a first example wear profile of an example grinding roll.

FIG. 3*a* shows the state of an unworn assembly. FIGS. 3*b*, 3*c* and 3*d* show various wear profiles, the assembly according to FIG. 3*b* being partly worn, the assembly in FIG. 3*c* being worn in a contour-shaped manner, and the roll surface being partly cracked in FIG. 3*d*.

The monitoring devices 10, 11 are preferably designed in such a way that they can carry out monitoring of the rotating surfaces 1*a*, 2*a* during grinding operation. In this way, the increasing wear can be detected in good time, with the result that the method of operation of the plant can be adapted to the determined wear state. If the repair and service of the assemblies 1 and 2 takes place at predefined intervals, the method of operation of the roll press is adapted to the determined wear state of the rotating surfaces 1*a* and 2*a* in such a way that the plant can be operated until the provided service and repair interval time. Under some circumstances, this can lead to the throughput of the roll press possibly being reduced somewhat by way of the modified method of operation. Without adaptation, operation would possibly have to be set prematurely, which would result in a lower overall throughput overall. Therefore, a more economical method of operation of the plant results from the fact that the method of operation of the plant is adapted to the wear state of the rotating surface. Here, in particular, a change in the rotational speed of the grinding rolls and an adaptation of the grinding pressure by way of the pressing device may be suitable as measures. Here, the adaptation of the grinding pressure can be realized, in particular, by way of a change in the ratio of gas pressure to oil pressure in the hydro-pneumatic adjusting element 9.

Figure 4:
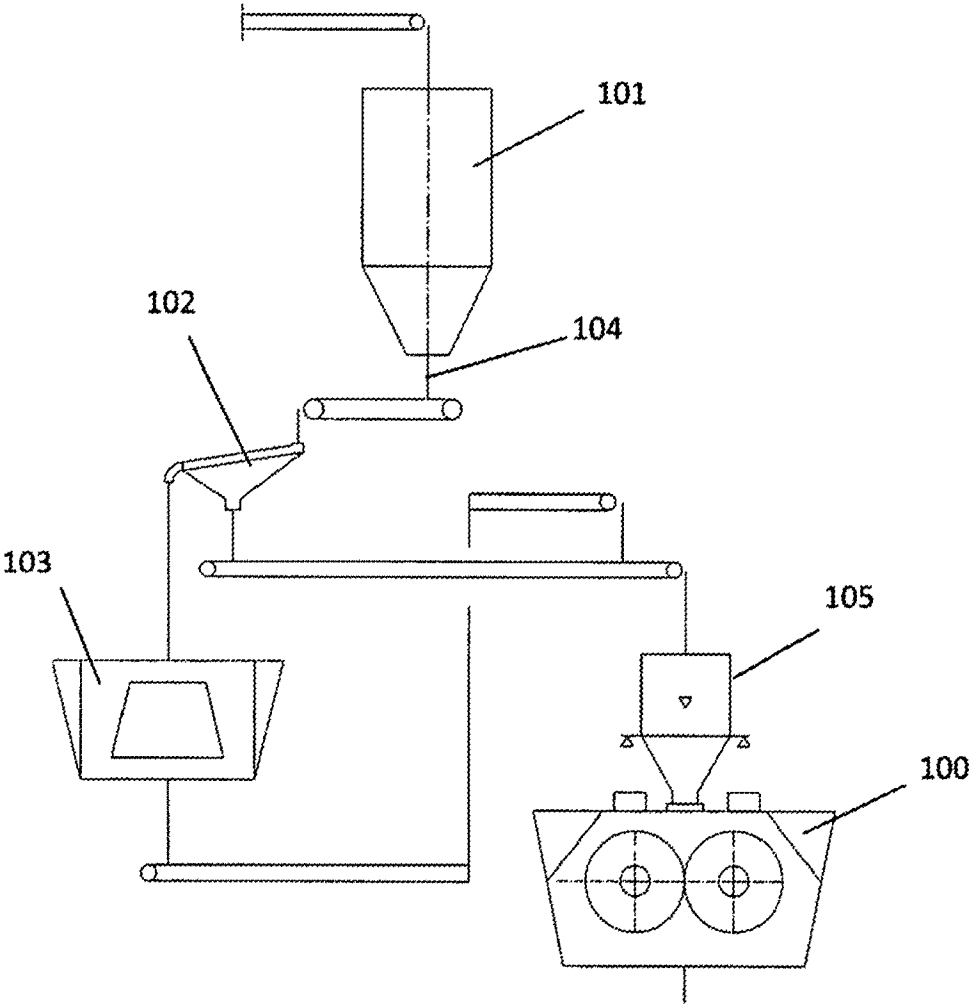
FIG. 4 is a schematic view of an example plant including an example roll press and an example upstream screening and crushing stage.

In the plant according to FIG. 4, in addition to the roll press 100, a pre-bunker 101 for the intermediate storage of the material to be comminuted, a screening stage 102 and a crushing stage 103 for pre-treatment of the material 104 to be comminuted are provided. The material 104 to be comminuted which is intermediate-stored in the pre-bunker 101 passes first of all into the screening stage 102, the fine proportion passing directly into an input shaft 105 of the roll press 100 and the coarse material passing there via the crushing stage 103. The wear speed of the grinding rolls of the roll press 100 also depends, inter alia, on the particle size and/or particle composition of the material to be comminuted. Shifting of part of the comminution work from the roll press 100 to the crushing stage 103 therefore has a direct influence on the speed, at which the rotating surface of the assemblies of the roll mill wears.

Figure 5:
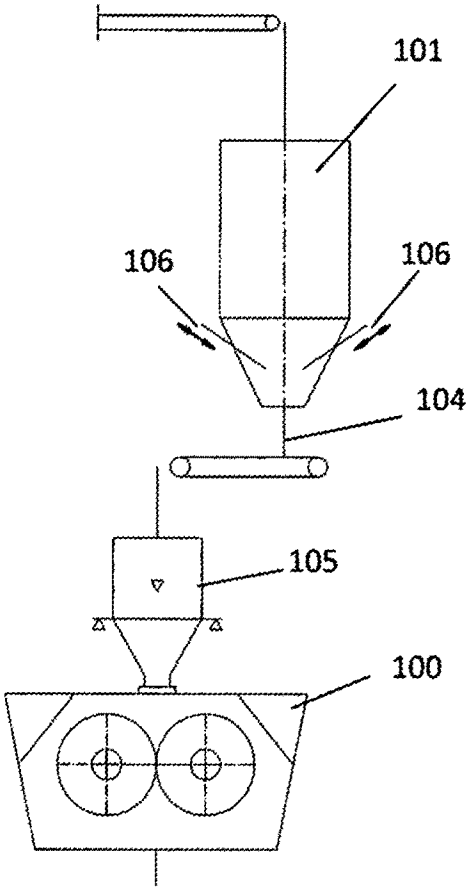
FIG. 5 is a schematic view of an example plant including an example roll press and an example pre-bunker for intermediate storage of material to be comminuted.

FIG. 5 shows a plant, in which the material 4 to be comminuted passes directly from a pre-bunker 101 to the roll press 100, without previously running through a screening or crushing stage. The material flow from the pre-bunker 101 is influenced by way of the position of slides 106. The quantity of the material which is fed to the roll press 100 is also regulated correspondingly in this way. Increased wear on the rotating surfaces 1*a*, 2*a* of the grinding rolls can be caused by an excessively low mass flow of the material to be comminuted, since individual particle comminution takes place increasingly in this case instead of material bed comminution. An increase in the mass flow by way of a corresponding position of the slide 106 can therefore bring about an improvement.

What is claimed is:

1. A method for operating a plant having at least one assembly that is serviced or repaired at scheduled intervals, wherein the at least one assembly includes a rotating surface that wears to an increasing extent during operation of the plant, the method comprising:

evaluating the wear state of the rotating surface of the at least one assembly; and modifying a manner of operating the plant based on the wear state of the rotating surface, wherein the modified manner of operating the plant is adapted to the wear state of the rotating surface such that a remaining running time of the at least one assembly corresponds with an amount of time until a next-scheduled interval for service or repair.

2. The method of claim 1 wherein the evaluating the wear state of the rotating surface occurs during running operation of the plant.

3. The method of claim 1 wherein a speed at which the rotating surface wears depends on the manner of operating the plant.

4. The method of claim 3 wherein the at least one assembly is a grinding roll.

5. The method of claim 3 wherein modifying the manner of operating the plant based on the wear state of the rotating surface comprises changing a quantity of water that is sprayed into or onto material to be comminuted.

6. The method of claim 3 wherein modifying the manner of operating the plant based on the wear state of the rotating surface comprises changing a quantity of grinding additive added to material to be comminuted.

7. The method of claim 1 wherein at least one purpose of the plant is to comminute bulky material.

8. The method of claim 7 wherein modifying the manner of operating the plant based on the wear state of the rotating surface comprises changing a contact pressure of a grinding roll of the at least one assembly.

9. The method of claim 7 wherein modifying the manner of operating the plant based on the wear state of the rotating surface comprises changing at least one of a material distribution or a mass flow of the bulky material to be comminuted.

10. The method of claim 7 wherein modifying the manner of operating the plant based on the wear state of the rotating surface comprises changing a feed quantity of the bulky material to be comminuted.

11. The method of claim 1 wherein the plant is operated as a roll press with two assemblies configured as grinding rolls.

12. The method of claim 11 wherein grinding pressures between the grinding rolls are controlled by a pressing device that includes at least one hydro-pneumatic adjusting element that is operated with gas and oil, wherein modifying the manner of operating the plant based on the wear state of the rotating surface comprises changing a ratio of a gas pressure to an oil pressure in the at least one hydro-pneumatic adjusting element.

13. The method of claim 1 wherein modifying the manner of operating the plant based on the wear state of the rotating surface comprises changing a rotational speed of the rotating surface.

14. The method of claim 1 wherein the at least one assembly comprises at least one of a screening stage or a crushing stage upstream of a grinding roll, with the at least one of the screening stage or the crushing stage being configured to pretreat material to be comminuted, wherein modifying the manner of operating the plant based on the wear state of the rotating surface of the grinding roll comprises changing a setting of the at least one screening stage or the crushing stage.

15. The method of claim 1 wherein the at least one assembly comprises a pre-bunker connected upstream of a grinding roll, wherein the pre-bunker is for intermediate storage of material to be comminuted and a flow of the material from the pre-bunker is influenced by a position of a slide of the pre-bunker, wherein modifying the manner of operating the plant based on the wear state of the rotating surface of the grinding roll comprises changing the position of the slide of the pre-bunker.

* * * * *